United States Patent [19]

Ringel et al.

[11] Patent Number: 4,815,384

[45] Date of Patent: Mar. 28, 1989

[54] HOUSING FOR JOINABLE CUTTING CHARGES

[75] Inventors: Konrad Ringel, Leinburg; Karl Rudolf, Schrobenhausen, both of Fed. Rep. of Germany

[73] Assignee: Diehl GmbH & Co., Nuremberg, Fed. Rep. of Germany

[21] Appl. No.: 143,464

[22] Filed: Jan. 12, 1988

[30] Foreign Application Priority Data

Jan. 14, 1987 [DE] Fed. Rep. of Germany ..... 3700802

[51] Int. Cl.[4] ..... F42B 1/02

[52] U.S. Cl. ..... 102/307; 102/310; 102/320; 102/321; 102/331

[58] Field of Search ..... 102/307, 308, 310, 320, 102/321, 331

[56] References Cited

U.S. PATENT DOCUMENTS 4,641,581 2/1987 Weickert et al. ..... 102/307

*Primary Examiner*—Peter A. Nelson

*Attorney, Agent, or Firm*—Scully, Scott, Murphy & Presser

[57] ABSTRACT

A housing for joinable or interconnectable cutting charges, which is constituted of a casing, two end surfaces or plates, two spacer flaps, and of the insert. The frontal surfaces of the inserts are at least flush with the surfaces of the end plates or project therebeyond by only a slight distance. The end plates are provided with bent or angled portions facing towards the explosive, wherein the angled portions are in surface contact with the inserts and are fixedly connected with the latter. Through the end surface which is bent over towards the explosive and the insert, the separating location between two neighboring cutting charges is relatively well sealed with respect to the exiting gases of the explosive.

2 Claims, 1 Drawing Sheet

HOUSING FOR JOINABLE CUTTING CHARGES

BACKGROUND OF THE INVENTION

1. Field of the Invention

The present invention relates to a housing for joinable or interconnectable cutting charges, which is constituted of a casing, two end surfaces or plates, two spacer flaps, and of the insert.

2. Discussion of the Prior Art

From the disclosure of German Petty Pat. No. 79 01 085, there has already become known a housing for joinable cutting charges, which facilitate that cutting charges can be arranged in a sequence and interconnected with each other through the intermediary of snap closures. Hereby, the connecting location between two adjacent contacting cutting charges is configured such that the end surfaces are presently in contact with each other; in essence, this means that a space is present between the inserts of two neighboring cutting charges, which corresponds to twice the thickness of the end surface or plate. Upon the detonation of the cutting charges there is encountered a loss in penetrating power at the separating location between the two cutting charges. This produces the result in the target object that the cutting profile evidences a so-called saw-tooth configuration which is associated with the separating location between the two cutting charges.

SUMMARY OF THE INVENTION

Accordingly, it is an object of the present invention to provide a housing for joinable or interconnectable cutting charges in which the formation of the so-called saw-tooth of the cutting profile in the target object is avoided or at least ameliorated to a considerable degree.

The foregoing object is inventively achieved through the intermediary of a housing for joinable cutting charges of the type under consideration herein in which the frontal surfaces of the inserts are at least flush with the surfaces of the end plates or project therebeyond by only a slight distance.

Further advantageous features of the invention can be readily ascertained from the following detailed description. Pursuant to the invention, there is achieved a significant improvement in the cutting profile formed into a target object.

For this purpose, it is significant that the mutually contacting end surfaces of the inserts are deformed under prestressing by means of a plurality of interconnected charges; and in effect, at the edge zones of their end surfaces, deformed into a hollow charge jet with almost the same energy. Only a smaller portion of the gases from the explosive, in contrast with that encountered in the state-of-the-technology, will escape from the separating location in a direction towards the target object.

In accordance with a further feature of the invention, the end plates are provided with bent or angled portions facing towards the explosive, wherein the angled portions are in surface contact with the inserts and are fixedly connected with the latter. Through the presence of the end surface which is bent over towards the explosive and the insert, the separating location between two neighboring cutting charges is relatively well sealed with respect to the exiting gases of the explosive. Consequently, the unhindered through-passage of the gases of the explosive at the separating location is delayed in time or retarded to such an extent in a direction towards the target object, that there is obtained the effect of a virtual seal at the separating location. Any disruption acting on the jet particles at the separating locations is lessened, and as a result thereof the cutting action is substantially improved over the entire length of the coupled cutting charges.

Pursuant to a further feature of the invention there are obtained inexpensive and stable fastenings of the angled portions with the inserts, in that the angled portions are fixedly fastened to the insert through the use of either screws or rivets.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
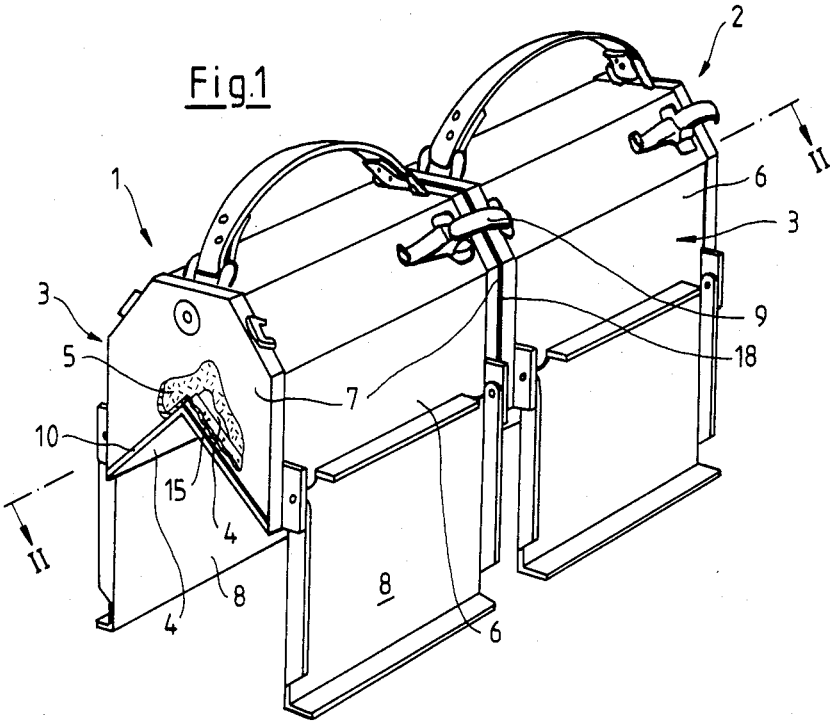
FIG. 1 illustrates a perspective view of two coupled or interconnected cutting charges.

Cutting charges 1 and 2 possess housings 3 constituted of sheet metal components for inserts 4 and for the cast or molded explosive 5.

The housing 3 consists of a casing 6, two end plates 7, and two spacer flaps 8.

Snap closures 9 couple or interconnect the cutting charges 1 and 2.

Figure 2:
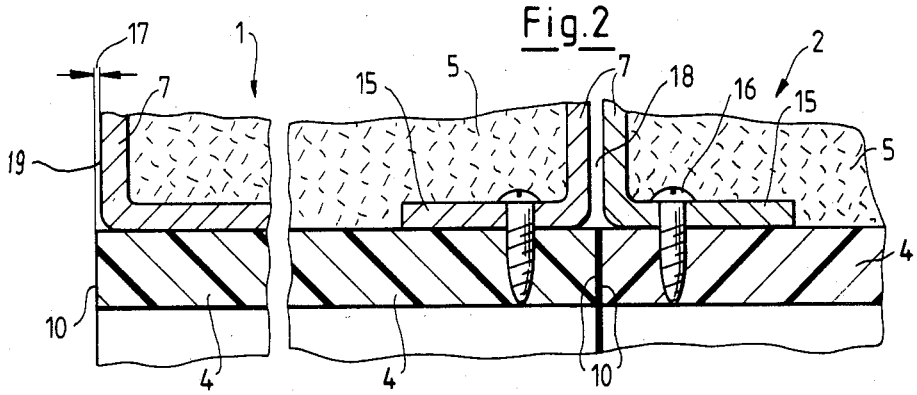
FIG. 2 illustrates, on an enlarged scale, a sectional view taken along line II—II in FIG. 1.
Figure 3:
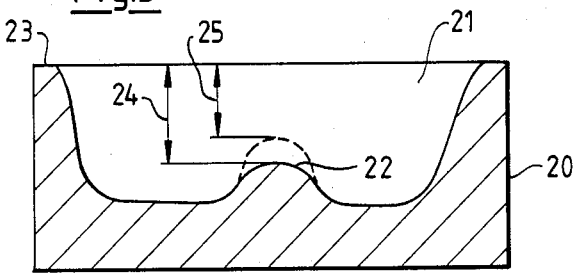
FIG. 3 illustrates the penetrating power of the cutting charges of FIG. 1 in a target object.

Pursuant to FIG. 2, the end plates 7 include portions 15 which are angled towards the explosive 5 and towards the insert 4. These portions 15 are fixedly interconnected with the inserts 4 through the illustrated screws 16. However, it is also possible to utilize rivets or other kinds of fasteners instead of the screws.

The frontal plates 10 of the inserts 4 project by the distance 17 beyond the surface 19 of the end plates 7. This distance 17 is maintained so small, that a gap 18 between the end plates 7 consists of only a few tenths of a millimeter.

Upon the detonation of the two cutting charges 1 and 2 pursuant to FIG. 1, in a target object 20 which is constituted of steel, there is formed the schematically illustrated cutout 21 possessing a hump, which is designated as a so-called saw-tooth 22. This hump evidences a cutting depth 24 with respect to the target surface 23. This depth is approximately 25% greater than a cutting depth 25 produced with cutting charges pursuant to the current state-of-the-technology.

The improved cutting depth 24 is attained, in that the gases of explosion from the detonating explosive 5 are relatively well sealed off at the separation location between two cutting charges 1, 2 through the angled portion 15 of the end plates 7. As a result, there is effected a relatively good transference of the energy of the explosive to the inserts 14 and; in essence, in the region of the gap 18 between the two cutting charges 1 and 2. The portions 15 virtually act as sealing sleeves.

What is claimed is:

1. A housing for joinable cutting charges, comprising a casing, two end plates, two spacer flaps, and an insert, said inserts having frontal surfaces which project beyond the surfaces of the end plates by a slight distance, the end plates of said housing including portions angled towards the explosive, said angled portions being in surface contact with the insert and being fixedly connected therewith.

2. A housing as claimed in claim 1, wherein screws or rivets fixedly connect said angled portions with the insert.

* * * * *